US005878920A

United States Patent [19]

Wiegner et al.

[11] Patent Number: 5,878,920

[45] Date of Patent: Mar. 9, 1999

[54] DISPENSER FOR DISCHARGING A FLOWABLE MEDIUM

[75] Inventors: Georg Wiegner, Flat E, 14/fl., Hilton Tower, 96 Granville Road, Tsimshatsui, Kowloon, Hong Kong; Hyeong Sook (Morin) Kim, Kowloon, Hong Kong

[73] Assignee: Georg Wiegner, Kowloon, Hong Kong

[21] Appl. No.: 891,661

[22] Filed: Jul. 11, 1997

[30] Foreign Application Priority Data

Jul. 29, 1996 [DE] Germany ..... 196 30 531.4
Oct. 18, 1996 [DE] Germany ..... 296 18 102.1

[51] Int. Cl.[6] ..... G01F 11/00

[52] U.S. Cl. ..... 222/260; 222/386.5

[58] Field of Search ..... 222/260, 386.5; 401/176, 286

[56] References Cited

U.S. PATENT DOCUMENTS 5,095,700 3/1992 Bolger ..... 60/517
5,389,155 2/1995 Lima ..... 134/8

FOREIGN PATENT DOCUMENTS 38 37 704 3/1994 Germany .
44 30 583 2/1996 Germany .
2 285 487 7/1995 United Kingdom .

*Primary Examiner*—Gregory L. Huson
*Attorney, Agent, or Firm*—Steven F. Caserza; Flehr Hohbach Test Albritton & Herbert LLP

[57] ABSTRACT

A dispenser for discharging a flowable medium, having an elongate storage container which receives the flowable medium, has an essentially constant inner cross-section, bears a manually actuable, suction-type discharge device at the top and contains a follow-on plunger which forms a base in the storage container and is in close contact with a dischargeable quantity of free-flowing medium. In order to provide a dispenser of the abovementioned type which is of simple construction and is subject to low wear, it is provided that the plunger is made up of a circumferentially closed-cell flexible foam, which has little or no capacity for adhesion, and is provided with a slightly oversized circumferential surface with respect to the inner cross-section of the storage container, with the result that the plunger can slide along the inner wall of the storage container.

13 Claims, 3 Drawing Sheets

DISPENSER FOR DISCHARGING A FLOWABLE MEDIUM

TECHNICAL FIELD

The invention relates to a dispenser for discharging a flowable medium.

BACKGROUND

A large number of dispensers are known for discharging (i.e. dispensing) liquid, pasty, gellike and powdery media from storage containers. These can be distinguished by two principal systems: those using plungers for pressing purposes and those using pumps for suction purposes. Dispensers of this type are often used in the consumer-article sector, these dispensers including, inter alia, soap dispensers, perfume dispensers and toothpaste dispensers.

At present, these dispensers are frequently installed in hand-held appliances, with the result that repeated refilling of the storage container with free-flowing medium is desirable. An example of such a hand-held appliance is constituted by dispenser-type toothbrushes, as are described in DE 31 04 862 A1. In this document, a toothbrush handle is provided as a storage body for a dentifrice supply, in order to feed dentifrice to a toothbrush head as required. The storage body contains a close-fitting plunger with a central, threaded bore. An outer screw-action head, which can-be actuated by a user, bears a threaded rod, which interacts with the bore in the plunger. Actuation of the screw-action head causes the plunger to move along the rod, with the result that dentifrice is discharged. The disadvantage here is that the threaded plunger rod is highly susceptible to contamination, and air, bacteria and dirt can pass into the dentifrice by way of the piston. Moreover, refilling is complicated and the system, as a whole, is highly susceptible to wear.

DE 4430583 A1 describes a toothpaste dispenser which has a pump for discharging toothpaste in a metered manner and having two parts, the pumping part and the storage container, which can be screwed to one another. This makes it possible to refill the storage container. The storage container contains a follow-on plunger which is sucked in the direction of the pumping part when toothpaste is sucked into the pumping space from the storage container. If the storage container is refilled, the plunger of the storage container is pushed as far as a plunger stop groove at the bottom. This allows the filling to be carried out easily and without any mess. It has, however, proved disadvantageous that the plunger sticks in the storage container, in particular when the dentifrice is pasty or free-flowing.

DE 3837704 C2 describes a dispenser with a metering pump for discharging metered quantities of pasty substances such as toothpaste, ointment or the like from bottles or can-like containers. Located in the container is a follow-on plunger which is inserted into the open bottom of the container. By virtue of the pasty substance being subjected to suction by the metering pump, the follow-on plunger is likewise subjected to suction and feeds the pasty substance remaining in the container in the direction of the metering pump. The plunger described here may also stick, as a result of which the functional reliability of the dispenser is vastly restricted.

SUMMARY

The object of the present invention is to provide a dispenser of the abovementioned type which is of simple construction and is subject to low wear.

In accordance with the present invention, a novel dispenser is taught whose plunger is inserted in the storage container, as a loose insert part, closely behind a supply of a flowable medium and which closely follows the flowable medium, by virtue of the suction action of a discharge device, without air passing the plunger and penetrating into the medium which is to be dispensed. This thus provides a closed system which, in addition, can be produced inexpensively. In one embodiment the plunger consists of a flexible foam, having a sponge-like elasticity which, if slightly oversized, makes it possible for the plunger to rest, under light pressure, against the inner wall of the storage container. Appropriate selection of material and material structure means that the plunger is lightweight and, even in the event of storage for a relatively long period of time, does not stick to the inner wall of the storage container. As a result, when the free-flowing medium is discharged, the plunger is drawn along as a base which adheres to the medium. The wear on such a plunger, which can be used repeatedly, is low.

Furthermore, it is particularly advantageous, in the case of this dispenser, that, as a result of its capacity for elastic deformation, the plunger can also be moved along curved regions. It is thus also possible to use storage containers which have curved sections. Furthermore, the plunger can be adapted to any storage container cross-sections.

In one embodiment the plunger has a crumpled circumferential surface, having the effect of a labyrinth seal on the inner wall of the storage container. Such a crumpled circumferential surface provides that the plunger can simply be inserted into the storage container, since it is still possible initially for the air contained in the storage container to escape. When the plunger comes into contact with the medium which is to be discharged, the various grooves of the crumpled circumferential surface fill with this medium, which results in an air-tight seal. In one embodiment the crumpled circumferential surface is provided with fine grooves by using a fine-celled flexible foam, of which the closed cells on the circumferential surface produce unevennesses which, taken altogether, result in a crumpled effect.

The foam section which is used as the plunger is, for example, obtained by cutting a strand to length. In order that the cut side which is directed towards the free-flowing medium has a closed-cell surface, the strand is in one embodiment cut to length by thermocutting. This has the effect of preventing the flowable medium from forming deposits in open cells of the plunger.

The plunger may be part of an extruded foam strand which has been cut to length. This means that it is inexpensive and quick to produce. The plunger may also be of a convex configuration, since such a form further enhances the capacity for the plunger to slide in curved sections.

Suitable foam materials are polyethylene or polypropylene, which have no capacity for adhesion and thus do not adhere, together with the medium which is to be discharged, on the inner wall of the storage container.

A pump device is suitable as the discharge device, it being possible to use a straightforward plunger pump or positive displacement pump, which means that the dispenser is functionally reliable and does not require a great deal of maintenance.

The storage container may consist of a rigid or flexible material, the use of flexible material making it possible to form fixed as well as variable curved regions, along which the plunger can slide.

The dispenser is suitable in particular for discharging pasty, viscous or liquid substances and can be installed in handheld appliances. For this purpose, the storage container, for example, can be designed as a toothbrush handle, or can be inserted therein, and the discharge device can feed a feed channel terminating at the toothbrush head.

Further configurations of the invention can be gathered from the following description and from the claims.

The invention is explained in more detail hereinbelow, with reference to the exemplary embodiments which are illustrated in the attached drawing, in which:

DESCRIPTION OF SPECIFIC EMBODIMENTS

Figure 1:
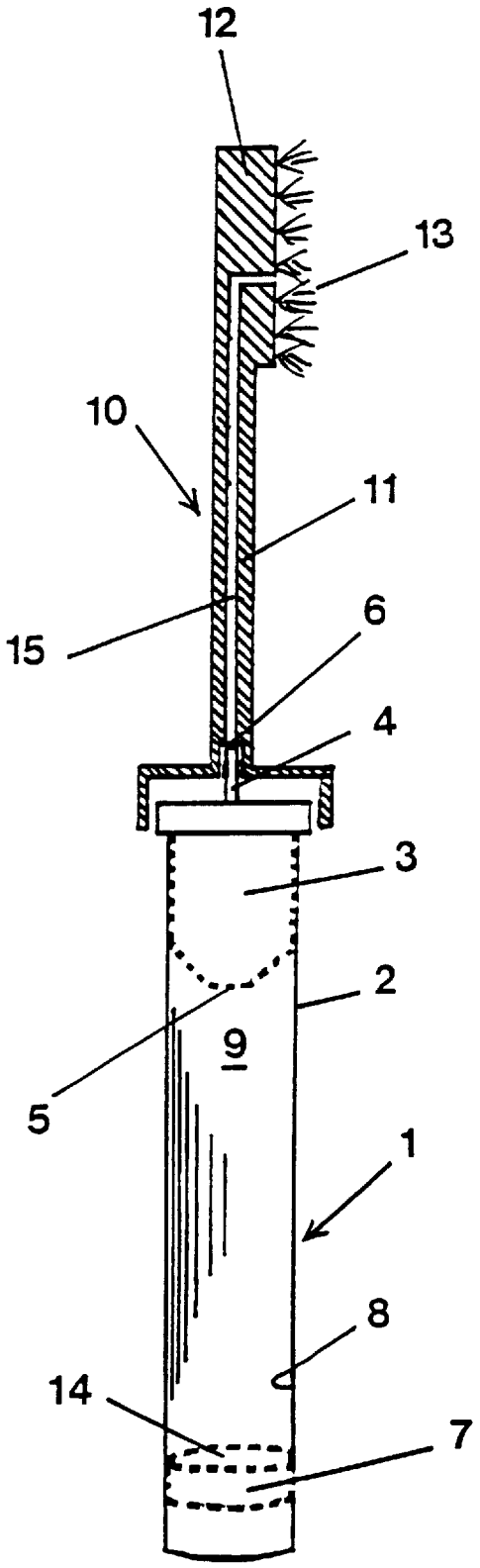
FIG. 1 shows, schematically, a side view of a first exemplary embodiment of a dispenser of this invention together with a toothbrush head attachment in longitudinal section.

FIG. 1 shows one embodiment of a dispenser 1 constructed in accordance with this invention, for discharging a flowable medium, in particular a pasty, viscous or liquid substance, having a cylindrical storage container 2 which receives a quantity of a flowable medium. The cylindrical storage container 2 may consist of a rigid or flexible material, for example glass or plastic, and in particular embodiments has a round or elliptical cross-section. As an elongate hollow body with essentially constant inner cross-section, storage container 2 may be of any cross-sectional shape.

A manually actuable, suction-type discharge device 3, which is preferably designed as a plunger pump or positive-displacement pump, is fastened at the top of storage container 2.

In the case of the dispenser illustrated in FIG. 1, the discharge device 3 provided is a plunger pump which, by virtue of a projecting plunger push rod 4 being pushed down, takes in flowable medium from the storage container 2 via a suction inlet 5 and discharges it via a suction outlet 6. The suction outlet 6 is, in one embodiment, provided on the plunger push rod 4.

The storage container 2 also contains a plunger 7 which can be moved in a longitudinal direction, rests circumferentially against an inner wall 8 of the storage container 2 and, at the bottom, is in contact with a dischargeable quantity of the flowable medium in the storage container 2. The plunger 7 is a loosely inserted base for the flowable medium contained in the storage container 2. Such a plunger 7 is a follow-on plunger, which is drawn along as a result of the suction action of the discharge device 3 and the resulting vacuum.

In one embodiment, plunger 7 is formed as a cylindrical section made of a circumferentially closed-cell flexible foam with little or no capacity for adhesion. In one embodiment plunger 7 is provided with a slightly oversized circumferential surface with respect to the inner cross-section of the storage container 2, with the result that the plunger 7 can slide along the inner wall 8 of the storage container. Since the circumference of the plunger 7 is slightly oversized with respect to the inner wall 8 against which it rests, said plunger has an outline which adapts to the cross-section of the storage container 2 and, in the event of small changes in cross-section in curved regions of the storage container 2, adapts in a close-fitting manner as a result of the capacity for elastic deformation of a soft foam.

Any cross-sectional shape may thus also be selected for the storage container 2 if the plunger 7 is roughly adapted in shape so as to ensure that the circumferential surface of the plunger 7 rests against the storage container with prestressing. As a result of the elastic structure of the material, precise adaptation is not necessary; the plunger 7 does this of its own accord.

In one embodiment, plunger 7 is made up of a substantially closed-cell flexible foam, to be precise of a fine-celled flexible foam being elastically reversible deformable. The bulk density of the foam is preferably between 30–70 kg/m$^3$ for a polymer polyethylene being extrusion cured foamed. Furthermore, the circumferential surface of the plunger 7 is preferably of crumpled design, which can be adjusted by the porousness of the flexible foam. Such a crumpled circumferential surface allows a labyrinth seal between the plunger 7 and the inner wall 8 of the storage container 2, with the result that the free-flowing medium contained in the storage container 2 is located in an inner space 9 of the storage container 2, said inner space being closed off by the plunger 7. The labyrinth seal which has been formed in this way provides that, in the event of the plunger 7 being inserted into the storage container 2 and displaced into close contact with the medium therein, it is still possible initially for the air present with the medium contained in the storage container 2 to escape. However, once a small quantity of the free-flowing medium passes into the crumpled circumferential surface, the grooves of the latter fill, with the result that the labyrinth seal takes effect.

In one embodiment plunger 7 is produced by an extruded soft-foam strand being cut to length to form cylindrical sections. This operation is preferably carried out by thermocutting, so that the cut sides have a closed-cell surface, in particular on the side 14 of the piston 7, said side 14 being directed towards the flowable material. Alternatively, it is also possible for the piston 7 to be injection molded, and thus also produced in convex form.

Suitable flexible-foam materials are polyethylene or polypropylene, since these are plastic materials which have no, or at most little, capacity for adhesion. Furthermore, these materials can be extruded or injection molded with a closed-cell surface.

If there is a flowable medium in the inner space 9 of the storage container 2, said inner space being bounded, at the top, by the discharge device 3 and, at the bottom, by the plunger 7, then, in the event of the flowable-medium being discharged, and of the resulting suction action, the plunger 7 is drawn along, due to the selection of material for the plunger 7 and the adaptation of the latter to the storage container 2.

Figure 2:
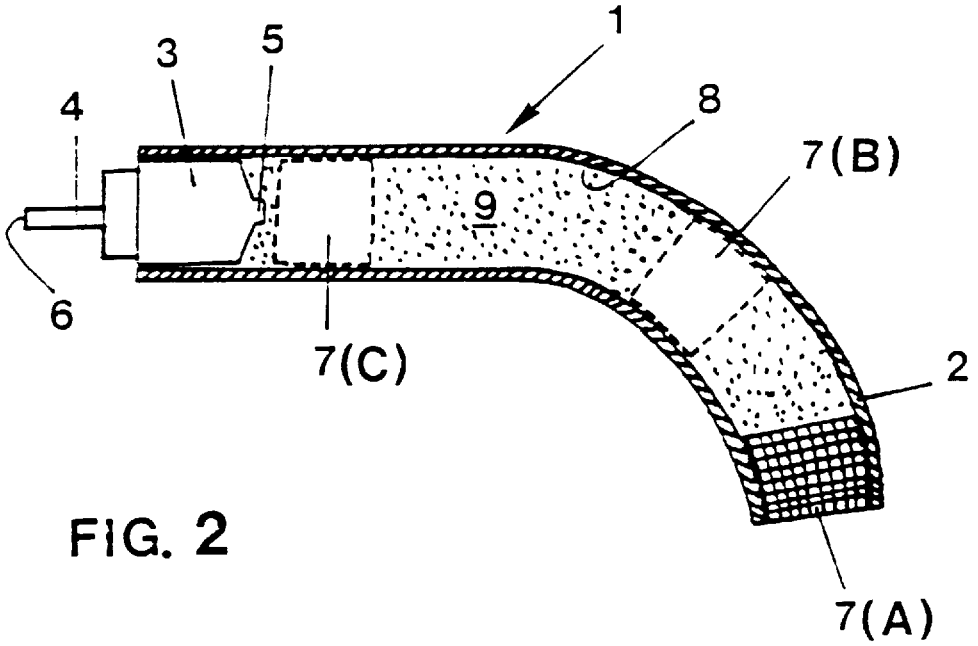
FIG. 2 shows, schematically, a longitudinal section of a second exemplary embodiment of a dispenser of this invention.

The inner space 9 filled with a flowable medium decreases as flowable material is discharged, the plunger 7 following closely, to be precise until the plunger 7 has advanced up to the discharge device 3 (cf. FIG. 2, position (C) of the plunger 7). An empty storage container 2 can be refilled by removing the plunger 7, refilling the container with flowable medium and reinserting the plunger 7 at the bottom.

The above described dispenser 1 can be installed in hand-held appliances, in particular in dispenser-type toothbrushes. As is illustrated in FIG. 1, the dispenser 1 may form a toothbrush handle directly, a toothbrush-head attachment 10 being attached. Such a toothbrush head attachment 10 includes a toothbrush-head neck 11 and a toothbrush-head plate 12 with bristles 13. A feed channel 15, which is routed through the toothbrush-head neck 11 and terminates at the toothbrush-head plate 12, is fed via the suction outlet 6 of the discharge device 3. The toothbrush-head attachment 10 can be fastened on the dispenser 1 in a known manner, if appropriate it can be seated on the plunger push rod 4, with the result that the discharge device 3 is actuated by the toothbrush-head attachment 10 and dispenser 1 being moved towards one another. Other known actuating means and ways of connecting the dispenser 1 and attachment 10 can be used.

FIG. 2 shows a second exemplary embodiment of the dispenser 1, this embodiment differing from that illustrated in FIG. 1 by virtue of the fact that the storage container 2 is not of rectilinear design, but rather is provided with a curved section. The storage container 2 may have one or more such curved sections. The plunger 7 can slide along such curved sections and fulfill its task as a base which follows the free-flowing medium which is to be discharged. In addition to an initial position of the plunger 7, which is designated by (A) and in which the storage container 2 is completely filled with the flowable material, further positions (B) and (C) of the plunger 7 are illustrated by dashed lines.

When the plunger 7 assumes the position (B), a quantity of the flowable medium has already been discharged, with the result that the plunger 7 is now seated in the curved section of the storage container 2, maintaining its full function in the process. When the plunger 7 assumes the position (C), virtually all of the flowable medium has been discharged, with the result that the plunger 7 has advanced up to the discharge device 3. Otherwise, all that has been said with respect to FIG. 1 applies correspondingly.

Figure 3:
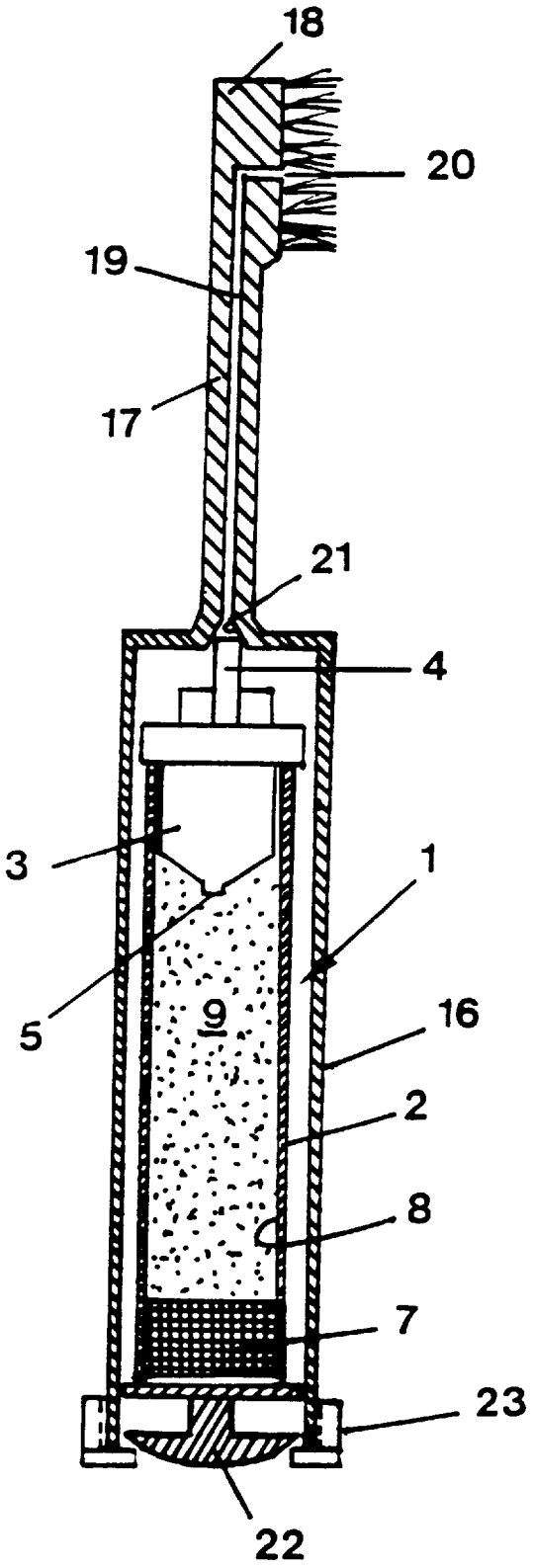
FIG. 3 shows, schematically, a longitudinal section of a dispenser of this invention in a toothbrush.

FIG. 3 shows an exemplary embodiment in which the dispenser 1 has been inserted into a toothbrush handle 16. Seated on the toothbrush handle 16 is-a toothbrush neck 17, which bears a toothbrush head 18 at the top. A channel 19 is routed through the toothbrush neck 17 and terminates in a discharge opening 20 in the toothbrush head 18. The dispenser 1 is mounted in the toothbrush handle 16 such that the plunger push rod 4 can be displaced against stop surfaces 21 of the channel 19. The dispenser 1 can be displaced axially by means of a push-button 22 at the bottom. Since the dispenser 1 strikes against the stop surfaces 21 by way of the plunger push rod 4, the pushing movement exerted on the push-button 22 pushes the plunger push rod 4 down and thus actuates the discharge device 3. The push-button 22 can be fastened on the toothbrush handle 16 by means of a screw cap 23. As far as the dispenser 1 is concerned, all that has been said with respect to FIG. 1 applies accordingly.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A dispenser for discharging a flowable medium, having an elongate storage container which receives the flowable medium, has an essentially constant inner cross-section, bears a manually actuable, suction-type discharge device at the top and contains a follow-on plunger which forms a base in the storage container and is in close contact with a dischargeable quantity of free-flowing medium, the plunger made up of a circumferentially closed-cell flexible foam, which has little or no capacity for adhesion, and being provided with a slightly oversized circumferential surface with respect to the inner cross-section of the storage container, with the result that the plunger can slide along the inner wall of the storage container for a self-acting follow-on.

2. A dispenser according to claim 1, the plunger having a crumpled circumferential surface which has the effect of a labyrinth seal.

3. A dispenser according to claim 1 or 2, the plunger consisting of a fine-celled flexible foam.

4. A dispenser according to claim 3, the plunger being designed in the form of a cylinder with a cut side which is directed towards the free-flowing medium and has a closed-cell surface obtained by thermocutting.

5. A dispenser according to claim 3, the plunger being part of an extruded foam strand which has been cut to length.

6. A dispenser according to claims 1 or 2, the plunger being of convex form.

7. A dispenser according to claims 1 or 2, the plunger being composed of foamed polyethylene or polypropylene.

8. A dispenser according to claims 1 or 2, the suctiontype discharge device being a positive-displacement pump or plunger pump which can be inserted into the top of the storage container.

9. A dispenser according to claims 1 or 2, the storage container consisting of a flexible material.

10. A dispenser according to claims 1 or 2, the storage container having at least one curved section.

11. A dispenser according to claims 1 or 2, the storage container forming a toothbrush handle to which a toothbrush neck, with a toothbrush head which has at least one discharge opening, can be attached such that the discharge device dispenses into a channel enclosed by the toothbrush neck.

12. A dispenser according to claims 1 or 2, the storage container being mounted in a toothbrush handle to which a toothbrush head, with at least one discharge opening for the flowable medium, is attached via a toothbrush neck such that the dispensing device dispenses into a channel enclosed by the toothbrush neck.

13. A dispenser according to claim 7, the plunger being composed of an extrusion cured foamed polyethylene having a bulk density between 30–70 kg/m$^3$.

* * * * *